US012000631B1

(12) United States Patent
Gill et al.

(10) Patent No.: US 12,000,631 B1
(45) Date of Patent: Jun. 4, 2024

(54) SYSTEMS AND METHODS FOR REFRIGERANT LEAK MITIGATION

(71) Applicant: Lennox Industries Inc., Richardson, TX (US)

(72) Inventors: Dilbag Singh Gill, Zira (IN); Patric Ananda Balan Thobias, Chennai (IN)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 18/065,077

(22) Filed: Dec. 13, 2022

(51) Int. Cl.
*F25B 41/20* (2021.01)
*F25B 41/31* (2021.01)

(52) U.S. Cl.
CPC ..... *F25B 41/31* (2021.01); *F25B 41/20* (2021.01); *F25B 2500/222* (2013.01); *F25B 2600/25* (2013.01); *F25B 2600/2501* (2013.01); *F25B 2600/2503* (2013.01); *F25B 2600/2523* (2013.01)

(58) Field of Classification Search
CPC ..... F25B 41/31; F25B 2500/222; F25B 2600/25; F25B 2600/2501; F25B 2600/2503; F25B 2600/2523
See application file for complete search history.

(56) References Cited

U.S. PATENT DOCUMENTS

2015/0377532 A1* 12/2015 Uselton ..... F25B 49/02 62/149
2017/0010030 A1* 1/2017 Tanaka ..... F25B 49/02
2020/0003467 A1* 1/2020 Noor ..... F25B 41/22
2020/0200456 A1* 6/2020 Fauser ..... F25B 45/00

FOREIGN PATENT DOCUMENTS

EP 4113038 A1 * 1/2023

* cited by examiner

*Primary Examiner* — Jonathan Bradford
(74) *Attorney, Agent, or Firm* — Baker Botts L.L.P.

(57) ABSTRACT

A method of operating an HVAC system includes compressing a working fluid using a compressor, removing heat from the working fluid using a condenser, removing pressure from the working fluid using an expansion valve, and transferring heat between airflow contacting an outer surface of one or more coils in an evaporator and the working fluid passing through the one or more coils. The method further includes detecting a leak of the working fluid using a leak detection sensor. The method further includes transporting at least a portion of the working fluid to a storage container and storing the working fluid in the storage container.

19 Claims, 2 Drawing Sheets

SYSTEMS AND METHODS FOR REFRIGERANT LEAK MITIGATION

TECHNICAL FIELD

This disclosure relates generally to heating, ventilation, and air conditioning (HVAC) systems. More particularly, in certain embodiments, this disclosure relates to systems and methods for refrigerant leak mitigation.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

Regulations in the HVAC industry are pushing manufacturers to transition away from traditional refrigerants towards low global warming potential (GWP) refrigerants, particularly mildly flammable (A2L) refrigerants and flammable (A3) refrigerants. Currently, there is a need to develop HVAC systems that are optimized for low GWP refrigerants. Notably, in the case of flammable refrigerants, such as A2L and A3 refrigerants, there is a need to develop mitigation systems and methods that can detect the presence of leaked refrigerant and implement strategies for mitigating the leak. This disclosure addresses the aforementioned problems by providing an HVAC system that can detect the presence of a leak and transport at least a portion or all of the refrigerant from the HVAC system to a storage container.

In an embodiment, the present disclosure provides a heating, ventilation, and air conditioning (HVAC) system configured to regulate a temperature of a space. The HVAC system comprises a compressor configured to compress a working fluid (e.g., a refrigerant) and a condenser configured to receive the working fluid compressed by the compressor and cool the working fluid. The HVAC system comprises an expansion valve configured to receive the working fluid cooled by the condenser and configured to decrease a pressure of the working fluid. The HVAC system comprises an evaporator configured to receive the working fluid from the expansion valve and configured to remove heat from airflow contacting an outer surface of one or more coils in the evaporator and the working fluid passing through the one or more coils, where the compressor is configured to receive the working fluid from the evaporator. The HVAC system comprises a storage container having a first opening and a second opening, where the first opening is configured to receive the working fluid from the condenser, and the compressor is configured to receive the working fluid from the second opening. The HVAC system comprises a first valve positioned between the storage container and the condenser, where the first valve is configured to move between a closed position and an open position to regulate the flow of the working fluid from the condenser to the storage container. The HVAC system comprises a second valve positioned between the storage container and the compressor, where the second valve is configured to move between a closed position and an open position to regulate the flow of the working fluid from the storage container to the compressor. In some embodiments, the HVAC system comprises a third valve positioned between the expansion valve and the condenser, where the third valve is configured to move between a closed position and an open position to regulate the flow of the working fluid from the condenser to the expansion valve.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
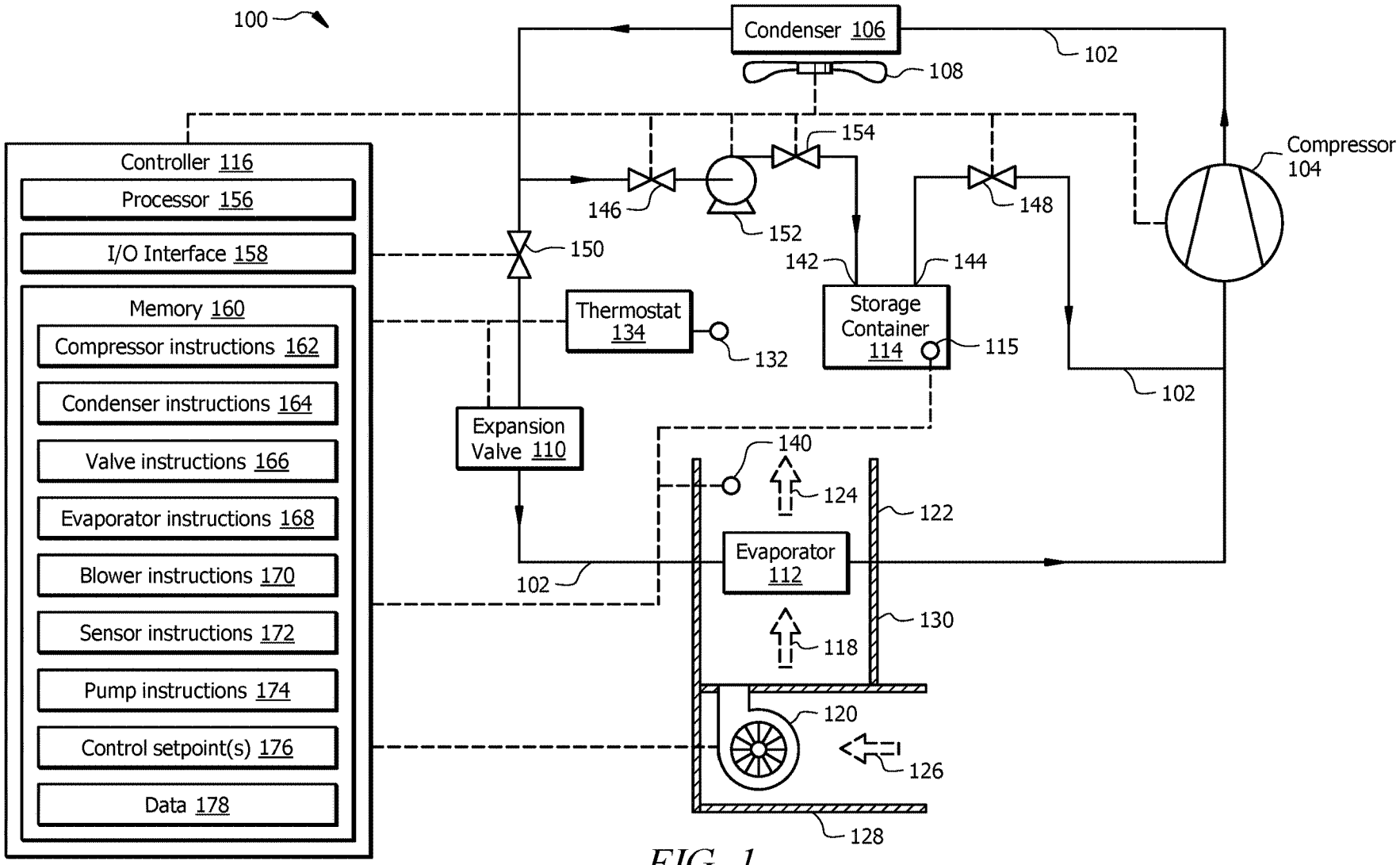
FIG. 1 is a diagram of an HVAC system according to some embodiments of the present disclosure.
Figure 2:
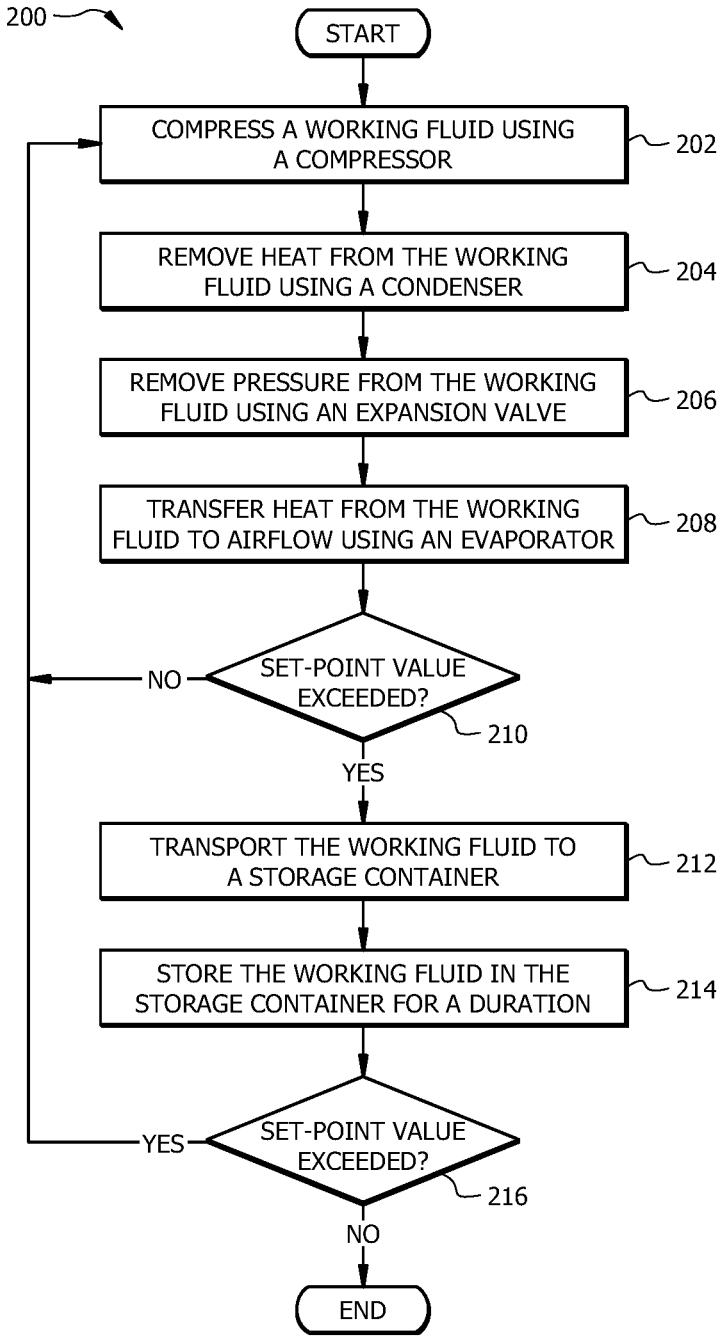
FIG. 2 is a flowchart of an example method of operating the system of FIG. 1.

Embodiments of the present disclosure and its advantages are best understood by referring to FIGS. 1 through 2 of the drawings, like numerals being used for like and corresponding parts of the various drawings.

As described above, regulations in the HVAC industry are pushing manufacturers to transition away from traditional refrigerants towards low global warming potential (GWP) refrigerants, particularly mildly flammable (A2L) refrigerants and flammable (A3) refrigerants. Currently, there is a need to develop HVAC systems that are optimized for low GWP refrigerants. Notably, in the case of flammable refrigerants, such as A2L and A3 refrigerants, there is a need to develop mitigation systems and methods that can detect the presence of leaked refrigerant and implement strategies for mitigating the leak. This disclosure addresses the aforementioned problems by providing an HVAC system that can detect the presence of a leak and transport at least a portion or all of the refrigerant from the HVAC system to a storage container.

HVAC System

FIG. 1 shows an example HVAC system 100 according to an embodiment of the present disclosure. The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building, and the conditioned air is delivered into the interior of the building. In other embodiments, portion(s) of the system 100 may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working fluid conduit 102, a compressor 104, a condenser 106, a fan 108, an expansion valve 110, an evaporator 112, a storage container 114, and a controller 116. The working fluid conduit 102 facilitates the movement of a working fluid (e.g., one or more refrigerant) through a cooling cycle such that the working fluid flows as illustrated by the arrows in FIG. 1. In some embodiments, the working fluid comprises a mixture of refrigerants. For example, the mixture of refrigerants may comprise at least a first refrigerant and a second refrigerant. In some embodiments, the working fluid comprises a mildly flammable A2L refrigerant, a flammable A3 refrigerant, or a combination thereof.

In some embodiments, the compressor 104 is fluidly coupled to the working fluid conduit 102 and compresses (i.e., increases the pressure) of the working fluid. The compressor 104 is in signal communication with the controller 116 using wired and/or wireless connection. The controller 116 provides commands and/or signals to control operation of the compressor 104 and/or receive signals from the compressor 104 corresponding to a status of the compressor 104. For example, the controller 116 may provide signals to instruct the compressor 104 to operate at a predetermined compressor speed.

The condenser 106 is configured to facilitate movement of the working fluid through the working fluid conduit 102. The condenser 106 is generally located downstream of the compressor 104, and receives the working fluid compressed by the compressor 104. The condenser 106 is configured to remove heat from the working fluid. The fan 108 is configured to move air across the condenser 106. In some embodiments, the compressor 104, the condenser 106, and the fan 108 are positioned in an outdoor unit, while other components in the HVAC system 100 are located indoors. The fan 108 may be configured to blow outside air through the condenser 106 to help cool the working fluid flowing therethrough. The fan 108 may be in communication with the controller 116 (e.g., via wired and/or wireless communication) to receive control signals for turning the fan 108 on and off. The controller 116 may also adjust the speed of the fan 108. The compressed, cooled working fluid flows from the condenser 106 toward the expansion valve 110.

The expansion valve 110 is coupled to the working fluid conduit 102 downstream of the condenser 106 and configured to remove pressure from the working fluid. The expansion valve 110 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 110 may be in communication with the controller 116 (e.g., via wired and/or wireless communication) to receive control signals for opening and/or closing associated valves and/or to provide flow measurement signals corresponding to the rate of working fluid flow through the working fluid conduit 102.

In some embodiments, an evaporator 112 is fluidly coupled to the working fluid conduit 102 and is configured to receive the working fluid from the expansion valve 110. The evaporator 112 is generally any heat exchanger configured to provide heat transfer between air flowing through (or across) the evaporator 112 (i.e., airflow 118 contacting an outer surface of one or more coils of the evaporator 112) and working fluid passing through the interior of the evaporator 112. The evaporator 112 may include one or more circuits of coils. The evaporator 112 is fluidically connected to the compressor 104, such that the compressor 104 is configured to receive working fluid from the evaporator 112 when operating to provide cooling.

In some embodiments, the HVAC system 100 comprises a blower 120 that is configured to transport airflow 118 across the evaporator 112 and out of a duct system 122 as conditioned airflow 124. Return air 126, which may be air returning from the building, fresh air form outside, or some combination, is pulled into a return duct 128. A suction side of the blower 120 pulls the return air 126. The blower 120 discharges airflow 118 into a duct 130 such that airflow 118 crosses the evaporator 112 or heating elements (not shown) to produce conditioned airflow 124. The blower 120 may use any mechanism (e.g., pull through or push through across evaporator coils) for providing airflow 118 through the HVAC system 100. For example, the blower 120 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower.

The HVAC system 100 includes a room sensor 132 in signal communication with the controller 116 (e.g., via wired and/or wireless connection). Room sensor 132 is positioned and configured to measure an indoor air temperature. The HVAC system 100 may include one or more further sensors (not shown for conciseness), such as sensors for measuring air humidity and/or any other properties of a conditioned space (e.g., a room of the conditioned space). Room sensor 132 and/or any other sensors may be positioned anywhere within the conditioned space, the HVAC system 100, and/or the surrounding environment.

The thermostat 134 may be located within the conditioned space (e.g., a room or building) serviced by the HVAC system 100. The controller 116 may be separate from or integrated within the thermostat 134. The thermostat 134 is configured to allow a user to input a desired temperature or baseline setpoint temperature for the conditioned space. In some embodiments, the thermostat 134 includes a user interface and display for displaying information related to the operation and/or status of the HVAC system 100. For example, the user interface may communicate with the display to show operational, diagnostic, and/or status messages and provide a visual interface that allows at least one of an installer, a user, a support entity, and a service provider to perform actions with respect to the HVAC system 100. For example, the user interface may communicate with the display to show messages related to the status and/or operation of the HVAC system 100.

The HVAC system 100 includes at least one leak detection sensor 140 in signal communication with the controller 116 (e.g., via wired and/or wireless connection). The at least one leak detection sensor 140 may be positioned anywhere in the HVAC system 100 such that the leak detection sensor 140 is configured to detect a leak of the working fluid. In the illustrated embodiment, the leak detection sensor 140 is positioned in or adjacent to the duct system 122. The leak detection sensor 140 is configured to measure at least one gas property value of fluid surrounding the sensor 140, which may include working fluid that has leaked from the HVAC system 100 (e.g., from the evaporator 112). The at least one gas property value of the fluid may be used to determine a concentration of working fluid that has leaked. Suitable gas property values include, but are not limited to, the speed of sound in the fluid, thermal conductivity of the fluid, or combinations thereof. In some embodiments, multiple leak detection sensors are used and positioned throughout the HVAC system 100 to detect for leaks. For example, a leak detection sensor 140 may be positioned adjacent to one or more sections of the working fluid conduit 102, the compressor 104, the condenser 106, the expansion valve 110, the evaporator 112, or combinations thereof.

The HVAC system 100 includes a storage container 114 fluidly coupled to the working fluid conduit 102. In general, the storage container 114 is configured to store at least a portion or all of the working fluid in the HVAC system 100. For example, the storage container 114 may be configured to store the working fluid in the event that a leak is detected by the leak detection sensor 140. In some embodiments, the storage container 114 includes a first opening 142 and a second opening 144 fluidly coupled to the working fluid conduit 102. The first opening 142 is configured to receive the working fluid from the condenser 106 and the second opening 144 is fluidly coupled to the compressor 104. The compressor 104 is configured to receive the working fluid from the storage container 114 via the second opening 144. The storage container 114 may include a sensor 115 configured to measure at least one fluid property of the working fluid in the storage container 114. The sensor 115 is in signal communication with the controller 116 (e.g., via wired and/or wireless connection) to send and receive signals regarding measurements of the fluid property. In some embodiments, the sensor 115 is a pressure sensor configured to measure a pressure of the working fluid in the storage container 114 or a level sensor configured to measure a fluid level of the working fluid in the storage container 114. The sensor 115 may separately or additionally measure other fluid properties (e.g., temperature, thermal conductivity, speed of sound). In some embodiments, the fluid property may be used to determine a concentration of the working fluid in the storage container 114.

In some embodiments, the HVAC system 100 includes a sensor 117 configured to measure one or more fluid property of the working fluid. In some embodiments, the sensor 117 is positioned in the working fluid conduit 102 to measure one or more fluid property of the working fluid. Although the sensor 117 is positioned between the condenser 106 and the expansion valve 150 in FIG. 1, it is to be appreciated that the sensor 117 may be positioned at any location in the working fluid conduit 102 to measure one or more fluid property of the working fluid. Additionally, a plurality of sensors 117 may be positioned at various locations within the working fluid conduit 102. The sensor 117 is in signal communication with the controller 116 (e.g., via wired and/or wireless connection) to send and receive signals regarding measurements of the fluid property. The sensor 117 may be a sensor configured to measure a pressure, a temperature, a thermal conductivity, a speed of sound of the working fluid, or any combination thereof.

The HVAC system 100 includes a first valve 146 fluidly coupled to the working fluid conduit 102. The first valve 146 is positioned between the storage container 114 and the condenser 106. The first valve 146 is configured to move between a closed position and an open position to regulate the flow of the working fluid from the condenser 106 to the storage container 114. The first valve 146 is in signal communication with the controller 116 (e.g., via wired and/or wireless connection) to receive signals for opening and/or closing. The HVAC system 100 includes a second valve 148 fluidly coupled to the working fluid conduit 102. The second valve 148 is positioned between the storage container 114 and the compressor 104. The second valve 148 is configured to move between a closed position and an open position to regulate the flow of the working fluid from the storage container 114 to the compressor 104. The second valve 148 is in signal communication with the controller 116 (e.g., via wired and/or wireless connection) to receive signals for opening and/or closing.

The HVAC system 100 includes a third valve 150 fluidly coupled to the working fluid conduit 102. The third valve 150 is positioned between the condenser 106 and the expansion valve 110. The third valve 150 is configured to move between a closed position and an open position to regulate the flow of the working fluid from the condenser 106 to the expansion valve 110. The third valve 150 is in signal communication with the controller 116 (e.g., via wired and/or wireless connection) to receive signals for opening and/or closing. Although not depicted for conciseness, sensor(s) may be positioned proximate to the first, second, and third valves 146, 148, 150 for measuring one or more operating parameters such as pressure, flowrate, and/or temperature of the working fluid, which may be communicated to the controller 116.

The HVAC system 100 may optionally include a pump 152 positioned between the first valve 146 and the storage container 114. The pump 152 is configured to transport the working fluid to the storage container 114. The pump 152 is in signal communication with the controller 116 (e.g., via wired and/or wireless connection) to receive signals for starting and/or stopping. In some embodiments, the pump 152 may be a variable speed pump and the controller 116 may provide signals for controlling the flow rate of the pump 152. The HVAC system 100 may optionally include a fourth valve 154. The fourth valve 154 is positioned between the pump 152 and the storage container 114. The fourth valve 154 is in signal communication with the controller 116 (e.g., via wired and/or wireless connection) to receive signals for opening and/or closing. The pump 152 and the fourth valve 154 are optional in that the compressor 104 may provide sufficient pressure to transport the working fluid to the storage container 114 without the pump 152 and the fourth valve 154. However, the pump 152 and the fourth valve 154 may provide improved control of the flow rate of working fluid to the storage container 114.

The controller 116 includes a processor 156, an input/output (I/O) interface 158, and a memory 160. The processor 156 comprises one or more processors operably coupled to the memory 160. The processor 156 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 160 and controls the operation of HVAC system 100. The processor 156 may be a programmable logic device, a microcontroller, a microprocessor, or any suitable combination of the preceding. The processor 156 is communicatively coupled to and in signal communication with the memory 160. The one or more processors are configured to process data and may be implemented in hardware or software. For example, the processor 156 may be 8-bit, 16-bit, 32-bit, 64-bit or of any other suitable architecture. The processor 156 may include an arithmetic logic unit (ALU) for performing arithmetic and logic operations, processor registers that supply operands to the ALU and store the results of ALU operations, and a control unit that fetches instructions from memory 160 and executes them by directing the coordinated operations of the ALU, registers, and other components. The processor 156 may include other hardware and software that operates to process information, control the HVAC system 100, and perform any of the functions described herein. The processor 156 is not limited to a single processing device and may encompass multiple processing devices.

The memory 160 includes one or more disks, tape drives, or solid-state drives, and may be used as an over-flow data storage device, to store programs when such programs are selected for execution, and to store instructions and data that are read during program execution. The memory 160 may be volatile or non-volatile and may comprise ROM, RAM, ternary content-addressable memory (TCAM), dynamic random-access memory (DRAM), and static random-access memory (SRAM). The memory 160 is operable to store any suitable set of instructions, logic, rules, and/or code for executing the functions described in this disclosure. For example, the memory 160 may store compressor operating instructions 162, condenser and fan operating instructions 164, valve operating instructions 166, evaporator operating instructions 168, blower operating instructions 170, sensor operating instructions 172, pump instructions 174, control setpoint(s) 176, and data 178 (e.g., gas property values measured from the leak detection sensor 142, temperature and pressure values, and/or operating parameters for components in the system 100).

The I/O interface 158 is configured to communicate data and signals with other devices. For example, the I/O interface 158 may be configured to communicate electrical signals with the other components of the HVAC systems 100. The I/O interface 158 may comprise ports and/or terminals for establishing signal communications between the controller 116 and other devices. The I/O interface 158 may be configured to enable wired and/or wireless communications. Connections between various components of the HVAC system 100 and between components of system 100 may be wired or wireless. For example, conventional cable and contacts may be used to couple the thermostat 134 to the controller 116 and various components of the HVAC system 100, including, the compressor 104, the fan 108, the expansion valve 110, the sensor 115, the sensor 117, the blower 120, the room sensor 132, the leak detection sensor 140, the first valve 146, the second valve 148, the third valve 150, the pump 152, and/or the fourth valve 154. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 116 to other components of the HVAC system 100.

In some embodiments, the controller 116 is configured to detect a leak of working fluid using the leak detection sensor 140. The leak detection sensor 140 may detect the leak of working fluid by measuring at least one gas property of fluid surrounding a component in the HVAC system 100. For example, the leak detection sensor 140 may measure a speed of sound through the fluid, a thermal conductivity of the fluid, or a combination thereof. The measured gas property values may be stored as data 178 in the memory 160. The measured gas property may be associated with a concentration of working fluid in the measured fluid. For example, the speed of sound or the thermal conductivity of the fluid will change depending on the concentration of working fluid present in the air. As such, a concentration of working fluid in the measured fluid may be determined using these exemplary gas properties.

The controller 116 may compare the measured gas property of the fluid to a control setpoint 176 stored in the memory 160. In some embodiments, the stored control setpoint 176 may be a threshold percentage of the lower flammability limit of the refrigerant(s) used in the working fluid. In some embodiments, the control setpoint 176 is a gas property value (e.g., speed of sound or thermal conductivity) associated with a threshold percentage of a lower flammability limit (LFL) of the working fluid in air at the operating temperature and pressure. The threshold percentage may be at least 5% of the lower flammability limit, at least 6%, at least 7%, at least 8%, at least 9%, at least 10%, at least 11%, at least 12%, at least 13%, at least 14%, at least 15%, at least 20%, at least 25%, to less than 30%, less than 40%, or less than 50% of the lower flammability limit of the working fluid in air at the operating temperature and pressure.

In some embodiments, the controller 116 is configured to determine that the gas property value measured using the leak detection device 140 exceeds the control setpoint 176. If the control setpoint 176 is exceeded, the controller 116 determines that a leak is detected. After detecting the leak of the working fluid, the controller 116 is further configured to transport at least a portion or all of the working fluid in the HVAC system 100 to the storage container 114. The controller 116 may transport the working fluid to the storage container 114 by opening the first valve 146 to allow the working fluid to flow from the condenser 106 to the first opening 142 in the storage container 114, close the second valve 148 to restrict flow from the second opening 144 in the storage container to the compressor 104, and close the third valve 150 to restrict flow from the condenser 106 to the expansion valve 110. After a duration of time where the working fluid flows into the storage container 114, the controller 116 is configured to close the first valve 146 to store at least a portion of the working fluid in the storage container 114.

In some embodiments, the sensor 115 in the storage container 114 may measure at least one fluid property of the working fluid as the storage container 114 is filled with working fluid. The controller 116 may continue to transport working fluid to the storage container 114 until a predetermined setpoint value associated with the fluid property is reached. The pre-determined setpoint value may include, but is not limited to, a pressure of the working fluid in the storage container 114 or a level of the working fluid in the storage container 114.

The controller 116 may be configured to store the working fluid in the storage container 114 until the leak detection sensor 140 measures one or more gas property of the fluid that is below the control setpoint 176. Additionally or alternatively, the controller 116 may receive user instructions to return a portion or all of the working fluid to the compressor 104. For example, a user (e.g., technician) may determine that the leak has been corrected or mitigated and provide instructions to the controller 116 to return the working fluid. Whether determined via the control setpoint 176 or user instruction, after a duration of time in which the working fluid is stored in the storage container 114, the controller 116 is further configured to open the third valve 150 to allow the working fluid to flow from the condenser 106 to the expansion valve 110 and open the second valve 148 to allow at least a portion or all of the working fluid to flow from the second opening 144 in the storage container 114 to the compressor 104. After a duration of time in which the working fluid flows from the storage container 114 to the compressor 104, the controller 116 is further configured to close the second valve 148.

In some embodiments, the sensor 117 is configured to measure one or more fluid property of the working fluid in the working fluid conduit 102. In some embodiments, the controller 116 may perform operations to add or remove an amount of working fluid within the working fluid conduit 102 using working fluid stored in the storage container 114. The addition or subtraction of working fluid may be in response to the one or more fluid property measured by sensor 117. In some embodiments, the controller 116 is configured to measure one or more fluid property of the working fluid in the working fluid conduit 102 using the sensor 117. In response to the one or more fluid property measured by sensor 117, the controller 116 may be configured to add working fluid to the working fluid conduit 102 by opening valve 148 to allow the working fluid to flow from the storage container 114 to the compressor 104. In some embodiments, in response to the one or more fluid property measured by sensor 117, the controller 116 may be configured to remove working fluid from the working fluid conduit 102 by closing valve 150 and opening valve 146 to allow the working fluid to flow from the condenser 106 to the storage container 114. In the case of the optional pump 152, this step may also include opening valve 154 and turning on pump 152 to transport the working fluid from the condenser 106 to the storage container 114. In this way, the controller 116 may be configured to regulate an optimum amount of working fluid in the HVAC system 100 by adding or removing working fluid via the storage container 114.

In some embodiments, the controller 116 may be configured to transport a pre-determined amount of working fluid to the compressor 104. The amount of working fluid returned may be tracked by the controller 116. For example, the controller 116 may monitor the flowrate of working fluid through the second valve 148 or by measuring one or more working fluid property using the sensor 115 that is indicative of the amount of working fluid returned (e.g., change in pressure of working fluid or change in fluid level of working fluid in the storage tank 114).

In the event that the optional pump 152 and the optional fourth valve 154 are used, the controller 116 may operate with a separate set of instructions. For example, after detecting the leak of the working fluid using the leak detection sensor 140, the controller may be configured to open the first valve 146 to allow the working fluid to flow from the condenser 106 to the pump 152, open the fourth valve 154 to allow the working fluid to flow from the pump 152 to the storage container 114, close the second valve 148 to restrict the flow of the working fluid from the storage container 114 to the compressor 148, and turn on the pump 152 to transport the working fluid from the condenser 106 to the storage container 114 also close the third valve 150 to restrict the flow of working fluid from condenser 106 to expansion valve 110. After a duration of time in which the working fluid flows into the storage container 114, the controller 116 is further configured to close the first valve 146 to restrict the flow of the working fluid from the condenser 106 to the pump 152 and close the fourth valve 154 to store the working fluid in the storage container. The controller 116 may follow the same instructions described above for returning the working fluid to the compressor 104.

FIG. 2 is a flowchart of an example method 200 of operating the system 100 of FIG. 1. Operations of method 200 may be implemented using the controller 116, processor 156, I/O interface 158, and the memory 160. Method 200 may begin at operation 202, which includes compressing a working fluid using a compressor 104. At operations 204-206, the method 200 includes removing heat from the working fluid using a condenser 106 and removing pressure from the working fluid using an expansion valve 110. At operation 208, the method 200 includes transferring heat between airflow 118 contacting an outer surface of one or more coils in an evaporator 112 and the working fluid passing through the one or more coils.

At operation 210, the method 200 includes detecting a leak using the leak detection sensor 140 by comparing a measured gas property value of fluid surrounding the HVAC system 100 to a control setpoint value 176. If it is determined that the setpoint value 176 is not exceeded, the method 200 repeats steps 202-208. If it is determined that the measured gas property value exceeds the control setpoint 176, the method 200 proceeds to operation 212.

At operation 212, the method 200 includes transporting at least a portion or all the working fluid to the storage container 114. Operation 212 may include opening the first valve 146, closing the second valve 148, and closing the third valve 150 to transport the working fluid from the condenser 106 to the storage container 114. Optionally, operation 212 may further include opening the fourth valve 154 and turning on the pump 152 to transport the working fluid from the condenser 106 to the storage container 114. At operation 214, the method 200 includes storing at least a portion of the working fluid in the storage container 114 for a duration of time. Operation 214 may include closing the first valve 146 in order to store at least a portion of the working fluid in the storage container 114.

At operation 216, the method 200 includes determining if the leak of working fluid has been mitigated. The method 200 may determine that the leak has been mitigated when the leak detection sensor 140 measures a gas property value of fluid that is below the control setpoint value 176. Alternatively or additionally, the controller 116 may receive user input (e.g., from a technician) indicating that the leak has been corrected or mitigated. If it is determined at operation 216 that the leak of working fluid has been mitigated, then the method 200 includes transporting at least a portion or all the working fluid from the storage container 114 to the compressor 104 and repeating steps 202-208. Operation 216 may include opening the third valve 150 and opening the second valve 148 to allow the working fluid to flow from the second opening 144 in the storage container 114 to the compressor 104. After a duration of time in which the working fluid flows from the storage container 104 to the compressor 104, operation 216 further includes closing the second valve 148 to restrict the flow from the storage container to the compressor 104. If it is determined that the control setpoint value 176 continues to be exceeded, then the method 200 may include continuing to store the working fluid in the storage container 114 or the method 200 may end.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system configured to regulate a temperature of a space, the HVAC system comprising:

a compressor configured to compress a working fluid;

a condenser configured to receive the working fluid compressed by the compressor and cool the working fluid;

an expansion valve configured to receive the working fluid cooled by the condenser and configured to decrease a pressure of the working fluid;

an evaporator configured to receive the working fluid from the expansion valve and configured to transfer heat between airflow contacting an outer surface of one or more coils in the evaporator and the working fluid passing through the one or more coils, wherein the compressor is configured to receive the working fluid from the evaporator;

a storage container having a first opening and a second opening, wherein the first opening is configured to receive the working fluid from the condenser, and the compressor is configured to receive the working fluid from the second opening;

a first valve positioned between the storage container and the condenser, wherein the first valve is configured to move between a closed position and an open position to regulate the flow of the working fluid from the condenser to the storage container;

a second valve positioned between the storage container and the compressor, wherein the second valve is configured to move between a closed position and an open position to regulate the flow of the working fluid from the storage container to the compressor; and a third valve positioned between the expansion valve and the condenser, wherein the third valve is configured to move between a closed position and an open position to regulate the flow of the working fluid from the condenser to the expansion valve, wherein when the third valve is in the open position during a cooling cycle the working fluid flows from the condenser to the third valve prior to being received by the expansion valve, and when the third valve is in the closed position during the cooling cycle the third valve is configured to direct the working fluid exiting the condenser to the first valve and the storage container.

2. The HVAC system of claim 1 further comprising:

a leak detection sensor configured to detect a leak of the working fluid from the HVAC system;

a controller communicatively coupled to the first valve, the second valve, the third valve, and the leak detection sensor, wherein the controller is configured to:

detect the leak of the working fluid using the leak detection sensor, and after detecting the leak of the working fluid:

open the first valve to allow the working fluid to flow from the condenser to the storage container;

close the second valve to restrict flow from the storage container to the compressor;

close the third valve to restrict flow from the condenser to the expansion valve, and after a duration of time in which at least a portion of the working fluid flows into the storage container:

close the first valve to store at least a portion of the working fluid in the storage container.

3. The HVAC system of claim 2, wherein the storage container includes a sensor configured to measure a fluid property of the working fluid in the storage container, wherein the controller is communicatively coupled to the sensor, and wherein the controller is configured to:

measure the fluid property of the working fluid in the storage container using the sensor, and once a predetermined set-point value associated with the fluid property is measured by the sensor:

close the first valve to store at least a portion of the working fluid in the storage container.

4. The HVAC system of claim 3, wherein the set-point value associated with the fluid property comprises a pressure of the working fluid in the storage container or a level of the working fluid in the storage container.

5. The HVAC system of claim 2, wherein after a duration of time in which the working fluid is stored in the storage container, the controller is further configured to:

open the third valve to allow the working fluid to flow from the condenser to the expansion valve;

open the second valve to allow at least a portion of the working fluid to flow from the second opening in the storage container to the compressor, and after a duration of time in which the working fluid flows from the storage container to the compressor:

close the second valve.

6. The HVAC system of claim 2 further comprising:

a pump positioned between the first valve and the storage container, the pump configured to transport the working fluid to the storage container; and a fourth valve positioned between the pump and the storage container.

7. The HVAC system of claim 6, wherein the controller is communicatively coupled to the pump and the fourth valve, wherein the controller is configured to:

detect the leak of the working fluid using the leak detection sensor;

open the first valve to allow the working fluid to flow from the condenser to the pump;

open the fourth valve to allow the working fluid to flow from the pump to the storage container;

close the second valve to restrict the flow of the working fluid from the storage container to the compressor;

close the third valve to restrict the flow of the working fluid from the condenser to the expansion valve;

turn on the pump to transport the working fluid from the condenser to the storage container, and after a duration of time in which at least a portion of the working fluid flows into the storage container:

close the first valve to restrict the flow of the working fluid from the condenser to the pump; and close the fourth valve to store at least a portion of the working fluid in the storage container.

8. The HVAC system of claim 1 further comprising:

a sensor configured to measure one or more fluid property of the working fluid in the HVAC system;

a controller communicatively coupled to the first valve, the second valve, the third valve, and the sensor, wherein the controller is configured to:

measure one or more fluid property of the working fluid, and in response to the one or more fluid property measured by the sensor:

open the first valve to allow the working fluid to flow from the condenser to the storage container;

close the second valve to restrict flow from the storage container to the compressor;

close the third valve to restrict flow from the condenser to the expansion valve, and after a duration of time in which at least a portion or all of the working fluid flows into the storage container:

close the first valve to store at least a portion of the working fluid in the storage container.

9. The HVAC system of claim 1 further comprising:

a sensor configured to measure one or more fluid property of the working fluid in the HVAC system;

a controller communicatively coupled to the first valve, the second valve, the third valve, and the sensor, wherein the controller is configured to:

measure one or more fluid property of the working fluid, and in response to the one or more fluid property measured by the sensor:

open the second valve to allow at least a portion of the working fluid to flow from the storage container to the compressor, and after a duration of time in which the working fluid flows from the storage container to the compressor:

close the second valve.

10. A controller of a heating, ventilation, and air conditioning (HVAC) system, the controller comprising:

a processor communicatively coupled to:

a first valve positioned between a storage container and a condenser, wherein the first valve is configured to move between a closed position and an open position to regulate the flow of a working fluid from the condenser to the storage container;

a second valve positioned between the storage container and a compressor, wherein the second valve is configured to move between a closed position and an open position to regulate the flow of the working fluid from the storage container to the compressor;

a third valve positioned between an expansion valve and the condenser, wherein the third valve is configured to move between a closed position and an open position to regulate the flow rate of the working fluid from the condenser to the expansion valve, wherein when the third valve is in the open position during a cooling cycle the working fluid flows from the condenser to the third valve prior to being received by the expansion valve, and when the third valve is in the closed position during the cooling cycle the third valve is configured to direct the working fluid exiting the condenser to the first valve and the storage container;

a leak detection sensor configured to detect a leak of working fluid from the HVAC system;

wherein the processor is configured to:

detect the leak of the working fluid using the leak detection sensor, and after detecting the leak of the working fluid:

open the first valve to allow the working fluid to flow from the condenser to the storage container;

close the second valve to restrict the flow of the working fluid from the storage container to the compressor;

close the third valve to restrict the flow of the working fluid from the condenser to the expansion valve, and after a duration of time in which at least a portion of the working fluid flows into the storage container:

close the first valve to store at least a portion of the working fluid in the storage container.

11. The controller of claim 10, wherein the storage container includes a sensor configured to measure a fluid property of the working fluid in the storage container, wherein the controller is communicatively coupled to the sensor, and wherein the controller is configured to:

measure the fluid property of the working fluid in the storage container using the sensor, and once a predetermined set-point value associated with the fluid property is measured by the sensor:

close the first valve to store at least a portion of the working fluid in the storage container.

12. The controller of claim 11, wherein the predetermined set-point value associated with the fluid property comprises a pressure of the working fluid in the storage tank or a level of the working fluid in the storage tank.

13. The controller of claim 10, wherein after a duration of time in which the working fluid is stored in the storage container, the controller is further configured to:

open the third valve to allow the working fluid to flow from the condenser to the expansion valve;

open the second valve to allow at least a portion of the working fluid to flow from the second opening in the storage container to the compressor, and after a duration of time in which the working fluid flows from the storage container to the compressor: close the second valve.

14. The controller of claim 10, wherein the controller is communicatively coupled to a pump positioned between the first valve and the storage container, the pump configured to transport the working fluid to the storage container, and wherein the controller is communicatively coupled to a fourth valve positioned between the pump and the storage container.

15. The controller of claim 14, wherein the controller is configured to:

detect the leak of the working fluid using the leak detection sensor;

open the first valve to allow the working fluid to flow from the condenser to the pump;

open the fourth valve to allow the working fluid to flow from the pump to the storage container;

close the second valve to restrict the flow of the working fluid from the storage container to the compressor;

close the third valve to restrict the flow of the working fluid from the condenser to the expansion valve;

turn on the pump to transport a portion of the working fluid from the condenser to the storage container, and after a duration of time in which at least a portion of the working fluid flows into the storage container:

close the first valve to restrict the flow of the working fluid from the condenser to the pump; and close the fourth valve to store at least a portion of the working fluid in the storage container.

16. A method of using a heating, ventilation, and air conditioning (HVAC) system to regulate a temperature of a space, the method comprising:

compressing a working fluid using a compressor;

removing heat from the working fluid using a condenser;

removing pressure from the working fluid using an expansion valve;

transferring heat between airflow contacting an outer surface of one or more coils in an evaporator and the working fluid passing through the one or more coils;

detecting a leak of the working fluid using a leak detection sensor, and when the leak detection sensor detects a leak:

opening a first valve positioned between a storage container and the condenser;

closing a second valve positioned between the compressor and the storage container;

closing a third valve positioned between the condenser and the expansion valve during a cooling cycle to direct the working fluid exiting the condenser to the first valve and the storage container, wherein when the third valve is in the open position during the cooling cycle the working fluid flows from the condenser to the third valve prior to being received by the expansion valve;

transporting at least a portion of the working fluid to the storage container; and storing at least a portion of the working fluid in the storage container for a duration of time.

17. The method of claim 16, wherein after the duration of time in which the working fluid is stored in the storage container, the method further comprises:

transporting at least a portion of the working fluid from the storage container to the compressor.

18. The method of claim 16 further comprising transporting the working fluid from the condenser to the storage container using a pump.

19. The method of claim 16, wherein the working fluid comprises one or more A2L refrigerant, one or more A3 refrigerant, or a combination thereof.

* * * * *